US006718668B2

(12) United States Patent
Cozzilino

(10) Patent No.: US 6,718,668 B2
(45) Date of Patent: Apr. 13, 2004

(54) DISPLAY MEANS AND APPARATUS

(76) Inventor: Anthony Cozzilino, 284 Baylawn Ave., Copaigue, NY (US) 11726

( * ) Notice: Subject to any disclaimer, the term of this patent is extended or adjusted under 35 U.S.C. 154(b) by 0 days.

(21) Appl. No.: 10/114,079

(22) Filed: Apr. 2, 2002

(65) Prior Publication Data

US 2003/0182834 A1 Oct. 2, 2003

(51) Int. Cl.[7] ..... G09F 17/00
(52) U.S. Cl. ..... 40/604
(58) Field of Search ..... 40/470, 471, 479, 40/603, 604, 412, 413, 422; 160/120, 241

(56) References Cited

U.S. PATENT DOCUMENTS

| | | | | | |
|---|---|---|---|---|---|
| 2,893,162 | A | | 7/1959 | Knowles | 45/24 |
| 3,235,989 | A | | 2/1966 | Brooks | 40/130 |
| 3,390,259 | A | | 6/1968 | Angier | 240/11.2 |
| 3,391,481 | A | | 7/1968 | Lloyd | 40/130 |
| 3,426,461 | A | * | 2/1969 | Miller | 40/471 |
| 3,499,630 | A | | 3/1970 | Dashio | 256/13.1 |
| 3,521,413 | A | | 7/1970 | Scott et al. | 52/98 |
| 3,726,035 | A | * | 4/1973 | Bower et al. | 40/604 |
| 3,835,613 | A | | 9/1974 | Davies, Jr. | 52/656 |
| 3,951,556 | A | | 4/1976 | Strizki | 403/2 |
| 4,007,552 | A | | 2/1977 | Brooks | 40/130 |
| 4,007,564 | A | | 2/1977 | Chisholm | 52/98 |
| 4,038,767 | A | | 8/1977 | Chasin et al. | 40/125 |
| 4,041,861 | A | | 8/1977 | Alter | 101/128.4 |
| 4,233,769 | A | | 11/1980 | Archer | 40/607 |
| 4,255,889 | A | | 3/1981 | Logan | 40/518 |
| 4,265,039 | A | | 5/1981 | Brooks | 40/603 |
| 4,800,947 | A | | 1/1989 | Loomis | 160/368.1 |
| 4,922,988 | A | | 5/1990 | Loomis | 160/368.1 |
| 5,046,545 | A | * | 9/1991 | Loomis et al. | 160/368.1 |
| 5,174,055 | A | * | 12/1992 | Aiken | 40/518 |
| 5,344,206 | A | * | 9/1994 | Middleton | 296/97.8 |
| 5,517,778 | A | * | 5/1996 | Simson | 40/471 |
| 5,673,504 | A | | 10/1997 | Brown | 40/518 |
| 5,913,564 | A | * | 6/1999 | Stewart et al. | 296/172 |
| 5,953,840 | A | | 9/1999 | Simson et al. | 40/471 |
| 5,979,093 | A | * | 11/1999 | Harruff et al. | 40/471 |
| 6,105,290 | A | | 8/2000 | Coates et al. | 40/518 |

* cited by examiner

*Primary Examiner*—Lesley D. Morris

(57) ABSTRACT

Provided is a banner or picture support and display method and apparatus capable of displaying a banner, picture or other like object to the custom requirements of the object to be displayed or the user's requirements. The apparatus' design allows for it, and that which is to be displayed thereby, to be free standing, self contained and /or mounted to a "permannt" location as the user may determine. The banner support and display method and apparatus allows for the display of a banner or picture-whereby only the banner and not the display apparatus nest be visible.

16 Claims, 8 Drawing Sheets

DISPLAY MEANS AND APPARATUS

FIELD OF THE INVENTION

This invention relates to a banner support assembly for purposes of engaging and holding taut a banner or picture canvas. This invention relates to a connector assembly and in particular to a reconfigurable connector assembly suitable for a point-of-purchase advertising device.

While the following description will deal with application of the present invention to a "point-of-purchase" advertising device, it will be apparent that the present invention has more general application that may be used in both in door and out door applications.

BACKGROUND OF THE INVENTION

With the gross advertising budget of this nation being what it is, it is easy to believe that a tremendous amount of money and human energy goes into the production and maintenance of the billboard and sign system across the country. Signs have served many purposes including identifying a place of business, giving directional information, affording a warning and in promoting a product.

Early signs employed translucent or transparent display faces mounted on a cabinet that housed the wiring and also contained the source of illumination. Characters were painted or otherwise formed on the display face. Unfortunately, about the only practical material available for the display faces was glass. As a result, frequent replacement came to be expected because of breakage arising from projectiles thrown by vandals, objects carried by the wind or the force of the wind itself.

Of major importance to the outdoor sign industry was the development, more than a generation ago, of rigid plastic sheets or panels formed of such materials as acrylic, polycarbonate, butyrate and variations thereof One of the more popular has been a polycarbonate marketed by General Electric Company under the trademark LEXAN. It is reasonably unbreakable and exhibits sufficient surface hardness to withstand significant damage from most thrown or blown objects. Although often referred to as being "rigid", it actually exhibits a degree of resilient flexibility, and that can be both an advantage and a disadvantage. The advantage is that it is much safer and easier to handle than a material such as glass, and it also is capable of withstanding stresses developed by distortion in the cabinet and induced by wind or other forces. The primary disadvantage is that the same degree of flexibility also enables the sheet material to bow in an amount sufficient that the impact of severe wind is sufficient to cause the display face literally to blow out of the sign framework. At least usually, the face on the lee side first is sucked out by a combination of pumping by the other face and lowered pressure on the lee side. It has been stated that one major United States manufacturer spent approximately 1.4 million dollars in 1978 alone for the replacement of rigid plastic sign faces.

Other disadvantages of the rigid plastic sign faces include difficulties with cementing and other necessary fabrication techniques and in obtaining consistency of color during the production of a large number of display faces that are supposed to be identical. Additionally, the practical aspects of shipping, handling and installation limit the size of rigid plastic panels which may be used, so that larger signs require additional framework to support a plurality of panels arranged in a signal sign. The rigid plastic materials also are comparatively expensive. A typical outdoor sign might have dimension of 10×24 feet, and many such signs are much larger. The wind loss coupled with the sizes involved and the expense of the material concerned explains why a single company could incur substantial yearly replacement costs. What appears to be a major improvement, capable of overcoming at least most of the above-discussed problems and disadvantages, has been the development of a soft, cloth-like, stretchable fabric material for use as a display face. As marketed by the 3M Company under the trademark PANAFLEX, it has a weight about the same as heavy canvas. It presents a smooth surface and is translucent for light from internal illumination. This material is a polyvinyl chloride that is re-enforced with glass fibers that run through the material in both directions in a pattern resembling that in ordinary window screens. As a result, it is virtually impossible to tear; even if cut, the cut is unlikely to propagate. Should it be cut, or penetrated, the cut or hole can easily be patched in the field in a manner similar to and no more difficult than applying a patch to an innertube.

As presently manufactured, the material is white. Moreover, the same company has developed special pigments for use in decorating its surface with different colors. Those pigments may be applied by the use of screen-printing to produce full-color pictorials as well as letters, numbers and graphic symbols. A full range of colors is available, so that it is possible to perfectly match any standard color with consistency as between a large quantity of display faces. In contrast, the decoration of rigid plastic sign faces is limited, exhibits substantial inconsistency and, at least in certain colors, is prone to fade.

Aside from being unbreakable, another advantage is that the material may be supplied in rolls. Within reason, that removes all practical limitations upon the size of a single display panel and it greatly facilitates handling, shipping and installation.

Nonetheless, the fabric has some disadvantages. Like the rigid plastic material, it continues to be expensive. It currently becomes competitive only if produced in quantity for identical sign faces. Because the decoration is printed with a special silk screen for each given decoration, and a multiple-colored presentation requires that color separation techniques be used in the printing, it becomes very expensive to make only a single sign. Under these circumstances, use has generally been restricted to the fabrication of identical signs in quantities of about ten to one hundred or more. Nevertheless, the advantages have attracted substantial interest, and a demand has already developed for use of the material in signs of large size and quantity.

Of course, the stretchable fabric must be mounted to some sort of framework. The cabinet approach continues to be preferred, because that has a form factor ideally suited for the mounting in the row (or rows) of fluorescent tubes that today most commonly constitute the interior source of illumination. Moreover, the cabinet-type framework accommodates a weatherproof internal raceway in which lamp ballasts and connecting wiring may be disposed. Whatever the interior construction, the framework must be extremely rugged to support the weight of larger signs and to withstand gale winds. One sign may weigh several thousand pounds. A person who has observed a sign mounted atop a tall building often will be surprised, if she has an opportunity to close inspection, to discover how large it has to be in order that that displayed lettering may be read from ground level. It is not uncommon for such a sign to have a display face area of many-hundred square feet.

To exhibit the ruggedness necessary in larger signs, it has long been known to fabricate such signs of steel frameworks. Either angle or channel members are employed to form inwardly facing U-shaped channels which are mitred or otherwise joined successively one to the next in order to form a rectangular cabinet. Combinations of slots, ledges, clamps and the like have then been used to secure the rigid panels that form the display faces to the resulting framework. Steel frameworks are still widely used in the sign industry, particularly by the smaller, independent fabricators.

After assuring proper functioning in all respects, and also giving due consideration to the cost of parts and labor for installation, the originator of the PANAFLEX stretchable fabric has recommended an approach which involves the use of a clamp assembly at each of a plurality of locations spaced around the perimeter. Small holes are drilled or punched in the edge margin of the fabric with the holes typically being spaced successively apart by a distance of one foot or less. Each assembly includes a stamped steel clamp that has a pair of elements that are situated on opposed surfaces of the fabric and have apertures through which a bolt is inserted as well as through the hole formed in the fabric. A first nut tightens the clamp about the fabric. The other end is inserted through a hole formed in an arm of a bracket or hook by means of a second nut threaded onto the outer end of the bolt. For installation, the bracket or hook is attached to the main structural framework of the sign. After everything has been mounted, the fabric is tensioned by turning the aforementioned second nut to draw the suspended clamp toward the bracket.

The bracket may have whatever shape is necessary for the purpose of most conveniently securing it to a surface presented by the main framework. In one specific form that has been successfully used, it is shaped to include a portion which seats directly into the groove and shelf formed in the side wall of the primary extrusion. Regardless of the kind of framework employed, however, installation and adjustment of the multiplicity of clamp assemblies has been found to be tedious and time consuming. Adding to the time required has been the necessity of establishing a chalk line or other reference mark around the display face to determine the exact location of the required bolt holes for obtaining the proper amount of tension in the fabric.

For proper performance, each different face must be tensioned a given percentage of its length in the direction of the tension. Consequently, any given tensioning device must be capable of imposing an adjustable amount of tension, or an uneconomical variety of different tensioning devices have to be provided to accommodate different sizes of display faces. As an example of the variation required, the chalk line is located inwardly, from what would be a proper position for the clamping holes if stretching were unnecessary, an amount which varies between one-fourth inch for a visible opening dimension of two feet to two-and-one-eighth inches for a dimension of forty-five feet.

The tension induced in the fabric also creates a pre-load on the sign framework. That tends to inwardly bow its horizontal and vertical components. Using the PANAFLEX fabric, the resultant force is twenty pounds per foot all around the periphery. That requires a framework stronger and heavier than a rigid display face which is suspended or supported from the framework only along the top and bottom support elements and then by means of a rigid straight edge.

As indicated above, one problem with the use of rigid display faces is that the pressure imposed by high winds in the gale and hurricane categories can be costly. Because the rigid faces are likely to fracture or be blown out of place, this has the backhanded advantage or relieving the wind force on the overall sign frame assembly to save it from destruction. Since the stretchable fabric will not analogously break or tear under extreme wind conditions, however, the avoidance of possible wind damage to the remainder of the sign assembly requires that it must be designed to withstand the maximum possible wind load. Based upon Uniform Building Code requirements, present industry practice for signs that use rigid plastic display faces is to engineer sign structures to withstand a maximum pressure of forty-five pounds per square foot. To withstand the forces developed by anything less than a tornado, use of the PANAFLEX fabric requires a design to withstand a pressure of fifty-five pounds per square foot plus the pre-load discussed above.

Another disadvantage with hardware presently available for the mounting of the stretchable fabric is the need for individual adjustment of tension and the handling of wrinkling at a large plurality of different locations spaced around the periphery of the display face. Those problems become accentuated when it is necessary to perform the necessary tasks on a frame assembly that is very large and/or spaced high above the ground or other mounting surface. These and other concerns are addressed by the present invention.

Other prior art teachings are related to tensioning fabrics suitable for screen printing. For example Knowles U.S. Pat. No. 2,893,162 shows an arcuate clamp 17 extending along the entire length of each side of the frame. The clamp contains a pair of bars 20 and 19 which engage the marginal edges of the screen and secure it in the arcuate portion of the clamp 17. Tension is placed upon the screen by adjusting the nut 21.

Brooks U.S. Pat. No. 3,235,989 discloses a main frame 2 with retainers 39 forming walls 53 and 54 to form a flange which holds rigid panels 22 in the flanges which extend along the bottom of the frame.

Angier U.S. Pat. No. 3,390,259 shows an aluminum frame forming central enclosures at 22 and 38 to house fluorescent tubes, etc. and a skirt extending from each side, one end of the skirt forming a drainage channel and the opposite end seating rigid panels 2 and 4. The panels are supported at the bottom by retainer 56.

Lloyd U.S. Pat. No. 3,391,481 shows aluminum retainers such as 6 in FIG. 5 extending along the sides of the frame. A rigid panel B is held in place by the retainer and seats on all four walls formed by the retainer 6.

A safety rail break-away post is shown in U.S. Pat. No. 3,499,630 and here again the break-away device is adjacent to the ground and all of the supported structure can tip over or topple when the break-away device fails.

Similar break-away bolts are shown in U.S. Pat. No. 3,521,413 where, again, the bolts are positioned at the base of the large light standard or pole and when broken will permit the standard to fall.

Davies, U.S. Pat. No. 3,835,613 shows a frame with retainers 4 and 5 adapted to hold a rigid plastic display face 7 in an offset 50 (see FIGS. 4 and 5). The panel 7 has a shoulder which rests upon the offset 40.

A device such as that is shown in U.S. Pat. No. 3,951,556 which has coupling members for the support bolts that have reduced diameter break-away sections. These bolts are at the base of the pole and when broken, the entire pole will topple.

Brooks, U.S. Pat. No. 4,007,552 likewise shows an extruded aluminum web 18A to secure a rigid sign face 12 against the main frame 14. Sign face 12 has shoulders 82 that are secured upon offset 26 of the main frame.

U.S. Pat. No. 4,007,564 depicts a device that shows a break-away coupling, again for the base of a light pole or standard, but of slightly different construction which permits the mounting bolts to break out sections of threaded supporting sleeves that receive the bolts.

Additionally, U.S. Pat. No. 4,038,767 discloses a flexible flag advertising sign where a stand having a plurality of overlapping flags or banners is employed. The banners can be folded back to display a selected one of the banners. This enables variation of the printed matter displayed but does not allow for a significant alteration in the overall shape and impact of the display.

Likewise, Alter U.S. Pat. No. 4,041,861 is directed to a clamping means for screen printing. In this disclosure a clamp 24 is slidable on a rail 27 which is integral with a bar 23. The bar is moved into tensioning position by means of bolts 14. In this disclosure, the clamps secure substantially the entire marginal edge of screen 11, the clamps at each corner of the frame being slidable along the rail (such as at end E in FIG. 2 after fall tension force is attained.

As another example, U.S. Pat. No. 4,233,769 discloses an upstanding advertising sign which employs a flag suspended from a flag pole, the flag pole being removably located in a pocket on the sign. There is no provision for significant visual variation in the sign or flag apart from changing the actual printed matter on the sign.

U.S. Pat. No. 4,265,039 (the '039 patent) teaches a framework for suspending a fabric display face and a clamp assembly for selective adjustment of fabric tension. The '039 patent teaches that prior art clamp assemblies required spaced holes to be punched in the fabric display through which bolts of the clamp assemblies were passed. The clamp assemblies were tightened around the fabric by means of a first nut, and the fabric was then tensioned by means of a second nut drawing the suspended clamp toward the mounted bracket. This system is undesirable from the standpoint that a plurality of holes are required in the fabric sign at prescribed intervals, and the fabric sign is prone to tearing during installation. In addition, multiple adjustments of the multiplicity of clamp assemblies to first tighten the clamp assembly around the fabric and then tension the fabric, is tedious and time consuming. The '039 patent teaches a fastening assembly having upper and lower support elements joined between corresponding opposite ends by respective side support elements. A hinge element is affixed to at least one of the support elements, and a hinge pin to which a marginal portion of the fabric is coupled may undergo limited rotation in conjunction with the hinge element to provide selective adjustment of the tension induced in the fabric.

Unfortunately, experience with fabric has shown that when stretched over the face of a billboard, under action of gravity, the fabric will wrinkle and stretch when exposed to the constant variations of temperature, humidity and precipitation of a billboard environment.

In view of all of the foregoing, it will be seen that the use of a stretchable fabric for display faces is attractive for a number of reasons. Yet, it also has presented several disadvantages because of its special characteristics that create a variety of new and different problems. Consequently, the sign industry as a whole has been very reluctant to adopt the stretchable fabric for widespread use. However, the present invention addresses these concerns by proposing a frame that allows a fabric sign to be quickly and easily tension mounted, and furthermore, has means to easily, and in an alternate embodiment, automatically, adjust the applied tension.

SUMMARY OF THE INVENTION

A banner support assembly with infinitely adjustable applied tension is disclosed. The primary components of the assembly include a mounting bracket, an adjustment means, a tension member, a reel and a clamp. The mounting bracket provides support for all components of the assembly. A standard fabric or other common flexible material banner with cylindrical bar means at the mounting extremities mates with the assembly.

Upon the mounting bracket, the adjustment means are coupled to the tension member which is wound around the reel. The clamp, which grips the cylindrical bar means of the banner, is coupled to the reel. Thus, by manipulating the adjustment means, the reel is made to rotate in the direction of the tension transferred by the tension member. Because the reel is coupled to the banner, the reel s rotation induces tension in the banner. The adjustment means allows infinite adjustability of the applied tension. Usually two or more of these assemblies would be used on opposite ends of the banner to maintain proper tension. However, other arrangements are possible. For example, in a reduced cost arrangement, one side of the banner may be fixed by conventional means, and at the opposite end, the present invention could be employed to adjust the tension. For instances wherein display quality is paramount, a four-sided banner could employ the present invention at three or four sides of the banner to ensure proper tension in all directions.

In an additional embodiment, a control system and motor are used to control the adjustment means. After initial user tensioning, the control system periodically pulses the motor to detect any slack in the tension member. If slack is detected, i.e., the motor rotates, the motor rotates the adjustment means until the slack is tightened, thus returning the sign back to proper tension. This is an important advancement because, as disclosed, a major drawback of fabric signs is their tendency to stretch By continuously monitoring the banner, the present invention can maintain display quality for a longer period than ever before possible with banner display apparatus of this type.

Accordingly, it is an object of the present invention to provide a banner support assembly that facilitates the mounting of a banner on a supporting member, yet with reliability such that the banner so mounted will remain on the supporting member and will not become disengaged therefrom.

It is a further object of the invention to provide a banner support assembly which allows rapid mounting of a banner onto a supporting member with a minimum of difficulty.

It is a further object of the invention to provide a banner support assembly which is composed of, other than fastening hardware, four component parts, that is, two sets of two parts which are identical, two parts of one set of which are adapted to be mounted in a spaced relation on a supporting member and the remaining two parts of the other set are each adapted affix or otherwise attach to the banner or item to be displayed.

Accordingly, it is a principle object of the invention to provide an improved banner display and support apparatus therefor.

It is an object of the present invention to provide a reconfigurable connector assembly and associated advertising device which alleviates at least to some of the aforementioned problems associated with the prior art.

Another object of the invention is to provide an improved display apparatus that allows for infinite adjustability.

A further object of the invention is to provide a banner display and support apparatus that shields some of the principle mechanics from the banner s viewer.

Another object of the invention is to provide kinetic banner display apparatus that is quickly and easily assembled and mounted for exhibit.

Accordingly, it is an object of the present invention to provide a banner support assembly which facilitates a mounting of a banner on a supporting member with a minimum of difficulty, but yet with reliability that the banner so mounted will remain on the supporting member and will not become disengaged therefrom due to wind, gravity or other elements acting on the banner supported by the banner support assembly.

It is a further object of the invention to provide a banner support assembly that may be free standing.

It is another object of the invention to provide a banner support assembly that may be temporally attached to a wall, ceiling or other structure.

It is another object of the invention to provide a banner support assembly that may be permanently affixed to a wall, ceiling or other structure.

It is a further object of the invention to provide a banner support assembly that allows rapid mounting of a banner onto a supporting member with a minimum of difficulty.

It is an additional object of the invention to provide a banner support assembly that uses tension to maintain visual integrity of the banner.

It is another objection of the invention to provide a banner support assembly that adjustably applies tension to a banner.

It is a further object of the invention to provide a banner support assembly that automatically provides proper tension to a banner.

In order that the invention can be more readily understood and be put into practical effect, reference will now be made to the accompanying drawings.

BRIEF DESCRIPTION OF THE DRAWINGS

Other objects and purposes of the invention will become apparent to persons having skill in the art by reading the following specification and inspecting the accompanying drawings, in which.

Certain terminology will be used in the following description for convenience in reference only and will not be limiting. The words "in" and "out" will refer to directions toward and away from, respectively, the geometric center of the device and designated parts thereof. The words "up" and "down" will indicate directions relative to the horizontal and as depicted in the various figures. Such terminology will include the words above specifically mentioned, derivatives thereof and words of similar import.

DETAILED DESCRIPTION

This invention teaches a device that provides an apparatus for tension mounting a flexible banner. Included are means for infinitely and easily adjusting the applied tension. In view of the very favorable characteristics of flexible signs (low weight, portability, availability of large sizes, etc), the present invention aims to address the main drawback of flexible signs, namely, their tendency to sag due to stretching of the flexible member. It has been heretofore contemplated that the device could find use as a point-of-sale advertising advice, or in any other type of indoor or outdoor application. Furthermore, an embodiment utilizing a motor and a control system automatically maintains proper tension on the banner. Such an embodiment could find preferred use in situations such as, but in no way limited to, banners to which access for maintenance is limited or inconvenient.

Thus, the following detailed description, read with the above-described drawings will serve to explain various preferred embodiments and components of the present invention.

Figure 1:
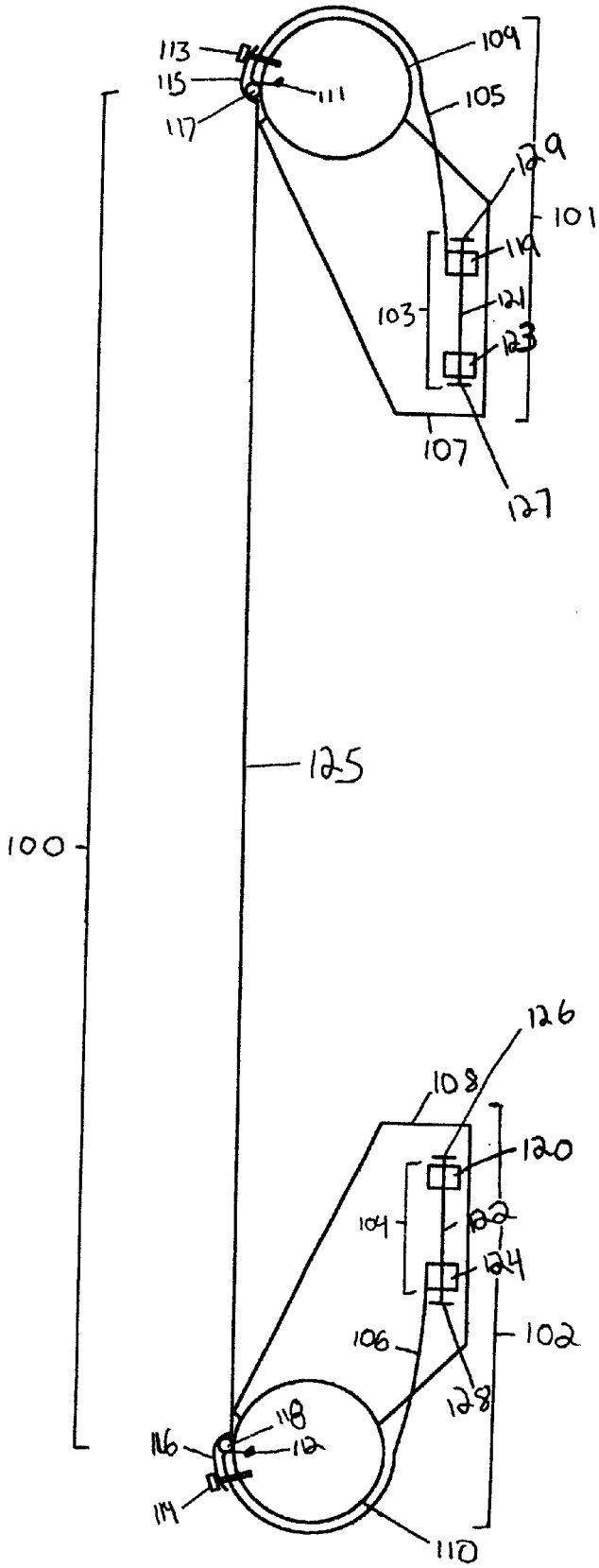
FIG. 1 is a side elevational view of a banner support assembly embodying the invention.

FIG. 1 depicts a side view of a banner mounting apparatus in accordance with the present invention. In this particular embodiment, mirror image apparatus 101 and 102 are used. However, an alternate embodiment may be used that reduces cost and complexity by fixably mounting one edge having bar structures 117 or 118 of banner 100 and utilizing a single apparatus 101 or 102. Banner 100 is comprised of flexible region 125 and bar structures 117 and 118. In the illustrated embodiment, mounting plates 107 and 108 structurally align the components of apparatus 101 and 102, respectively, and furthermore are fixably mounted to the surface which the user chooses to display banner 100. First, examining apparatus 101, keeping in mind that apparatus 102 operates in a completely analogous fashion, clamp 115 is used to keep bar structure 117 locked in place. The locking of bar structure 117 by clamp 115 is adjustable by screw 113. Preferably, clamp 115 is adjusted by screw 1 13 such that bar structure 117 may articulate by simply sliding into the plane of the figure. Screw 113 secures tension member 105 into rotatable reel 109. To prevent breakaway of the tension member 105, it is additionally fixed into rotatable reel 109 at point 111. Tension member 105 is then coupled to adjustment device 103. Adjustment device 103 comprise first block 119, second block 123 and threaded rod structure 121. Second block 123 is adjustable along the length of threaded rod structure 121, and is used to set a maximum tension By rotating threaded rod structure 121, first block 119, which has tension member 105 affixed thereto, translates downward, thus inducing a tensile stress in tension member 105. Threaded rod structure 121 may be rotated by using screwdriver or like means that could articulate with ends 127 or 129. An access region could be provided to facilitate access to adjustment means 103. The tensile stress effects rotation of rotatable reel 109, which in turn induces a tensile stress in flexible region 125. Now, examining apparatus 102, keeping in mind that apparatus 102 operates in a completely analogous fashion to apparatus 101, clamp 116 is used to keep bar means 118 locked in place. The locking of bar means 118 by clamp 116 is adjustable by screw 114. Preferably, clamp 116 is adjusted by screw 114 such that bar means 118 may articulate by simply sliding into the plane of the figure. Screw 114 secures tension member 106 into rotatable reel 110. To prevent breakaway of the tension member 106, it is additionally fixed into rotatable reel 110 at point 112. Tension member 106 is then coupled to adjustment means 104. Adjustment means 104 comprise first block 124, second block 120 and threaded rod means 122. Second block 120 is adjustable along the length of threaded rod means 122, and is used to set a maximum tension. By rotating threaded rod 122, first block 124, which has tension member 106 affixed thereto, translates upward, thus inducing a tensile stress in tension member 106. Threaded rod 122 may be rotated by using screwdriver or like means that could articulate with ends 126 or 128. An access region could be provided to facilitate access to adjustment means 104. The tensile stress effects rotation of rotatable reel 110, which in turn induces a tensile stress in flexible region 125.

Figure 2:
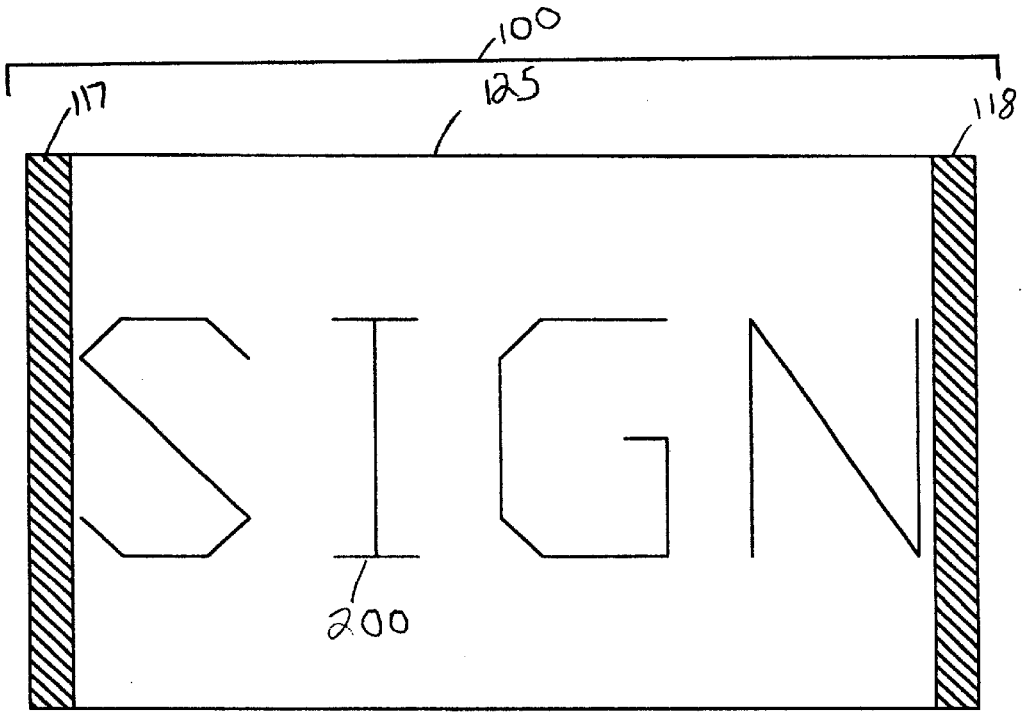
FIG. 2 is a front view of a banner for use with the present invention.

FIG. 2 depicts an exemplary banner 100 for use with the present invention. Banner 100 comprises bar means 117 and 118 and flexible region 125. Bar means 117 and 118 articulate with clamps of the apparatus in accordance with the present invention. Flexible region 125 of banner 100 could comprise content 200 of any variety, including, but not limited to, text and graphics. Furthermore, flexible region 125 is applied tension by the apparatus of the present invention to maintain its visual integrity.

Figure 3:
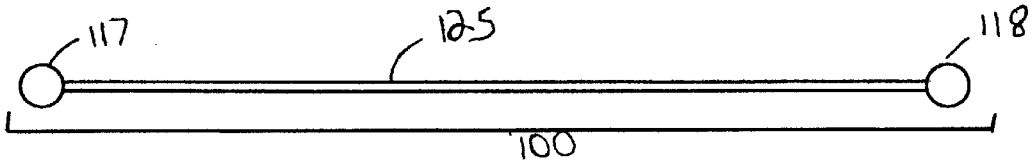
FIG. 3 is a side view of a banner for use with the present invention.

FIG. 3 depicts a side view of an exemplary banner 100 for use with the present invention. Bar means 117 and 118 articulate with clamps of the apparatus in accordance with the present invention. Flexible region 125 has a tension applied thereto by the apparatus of the present invention.

Figure 4:
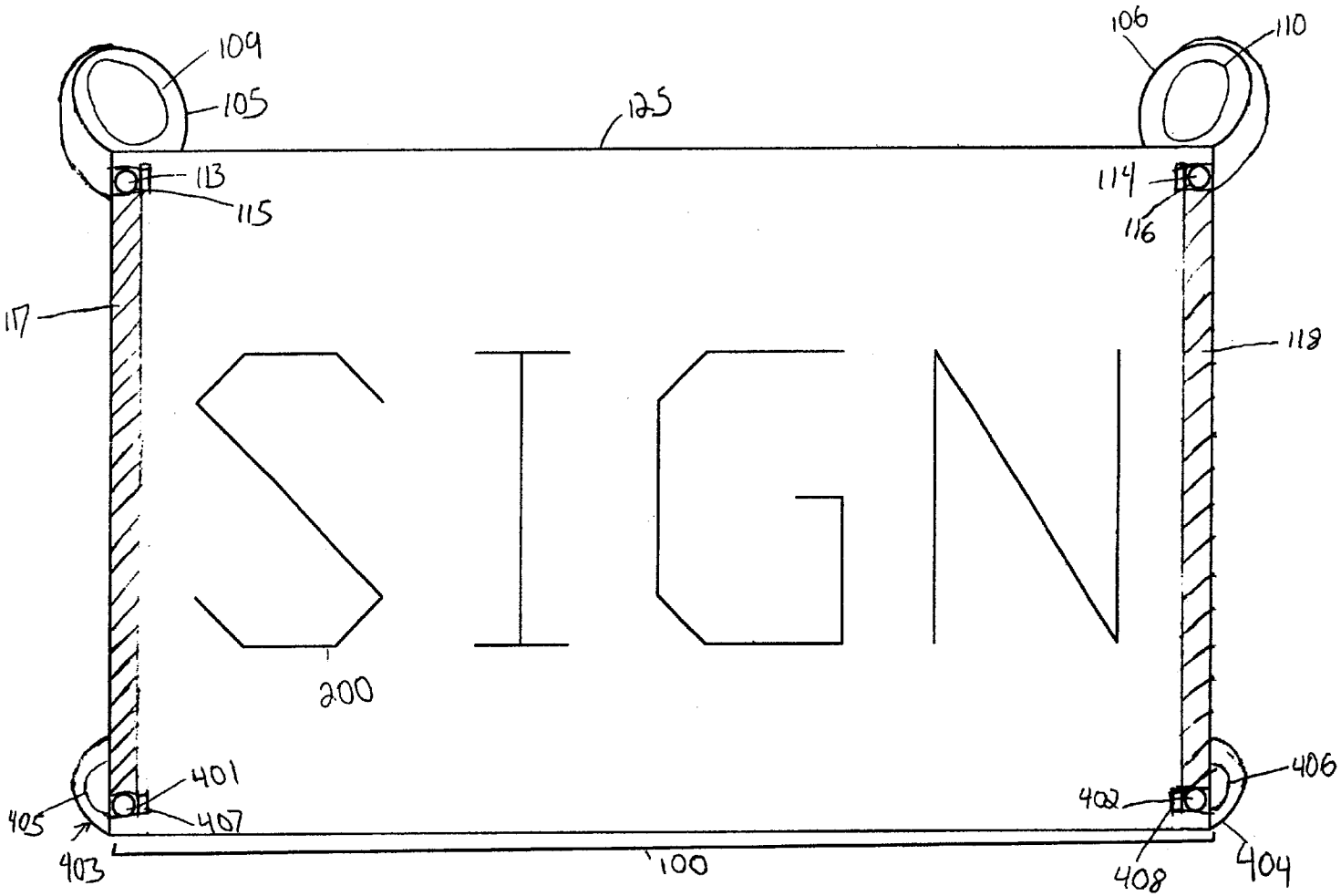
FIG. 4 is a front view of a banner support assembly embodying the present invention.

FIG. 4 depicts a front view of an apparatus in accordance with the present invention articulated with a banner 100. While this figure depicts a banner 100 with two apparatus per vertical side, this is merely exemplary. The banner 100 may instead be supported horizontally, or with any plurality of apparatus. Clamps 115 and 407 secure bar means 117. Screws 113 and 401 secure clamps 115 and 407 into tension members 105 and 403, respectively. Tension on said tension members 105 and 403 is maintained by rotation of reels 109 and 405, respectively. Bar means 118 is kept in tension by the analogous means. Clamps 116 and 408 secure bar means 118. Screws 114 and 402 secure clamps 116 and 408 into tension members 106 and 405, respectively. Tension on said tension members 106 and 404 is maintained by rotation of reels 110 and 406, respectively. Together, the maintenance of tension on both sides of sign 100 ensure the content 200 of flexible region 125 remains properly legible. It should be noted that items 109, 105, 106, 110, 403, 405, 404 and 406 have been described with reference to the current figure for the purpose of completely disclosing the invention. However, in practical use, the aforesaid items would not be, or at the most, marginally, visible from a frontal view as provided.

Figure 5:
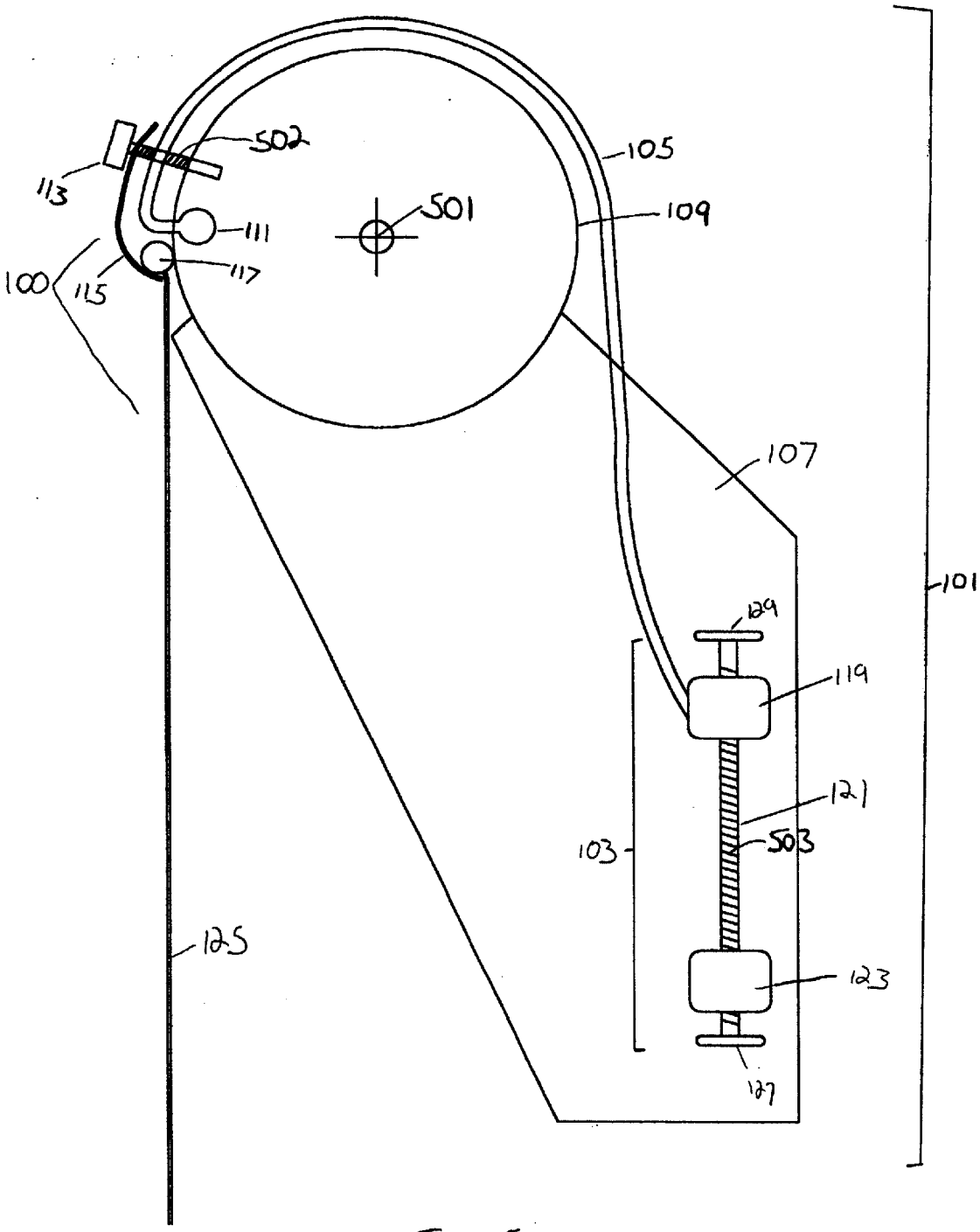
FIG. 5 is a detailed view of one manner of banner assembly attachment/control means.

FIG. 5 depicts a first apparatus 101 in accordance with the present invention. Banner 100 is comprised of flexible region 125 and bar means 117. In the illustrated embodiment, mounting plate 107 structurally aligns the components of the first apparatus 101, and furthermore, is used for mounting the first apparatus 101 to the surface the user wishes to display banner 100. Examining the first apparatus 101, clamp 115 is used to keep bar means 117 locked in place. The locking of bar means 117 by clamp 115 is adjustable by screw 113 which is threaded 502 to mate with reel 109. Preferably, clamp 115 is adjusted by screw 113 such that bar means 117 may articulate by simply sliding into the plane of the figure. Screw 113 secures tension member 105 into rotatable reel 109. To prevent breakaway of the tension member 105, it is additionally fixed into rotatable reel 109 at point 111. Tension member 105 is then coupled to adjustment means 103. Adjustment device 103 comprise first block 119, second block 123 and threaded rod means 121. Second block 123 is adjustable along the length of threaded rod means 121, and is used to set a maximum tension. By rotating threaded rod 121, first block 119, which has tension member 105 affixed thereto, translates downward, thus inducing a tensile stress in tension member 105. Block 119 has threads that mate with threads 503, and is constrained from rotating such that the rotation of bar 121 causes said downward translation Second block 123, however, is not constrained from rotation. Second block 123 has threads that mate with threads 503. Thus, the user may rotate second block 123 to any position along threaded rod 121, thereby setting a maximum tension. Threaded rod 121 may be rotated by using a screwdriver or like means that could articulate with ends 127 or 129. An access region could be provided to facilitate access to adjustment means 103. The tensile stress effects rotation of rotatable reel 109 about center 501, which in turn induces a tensile stress in flexible region 125.

Figure 6:
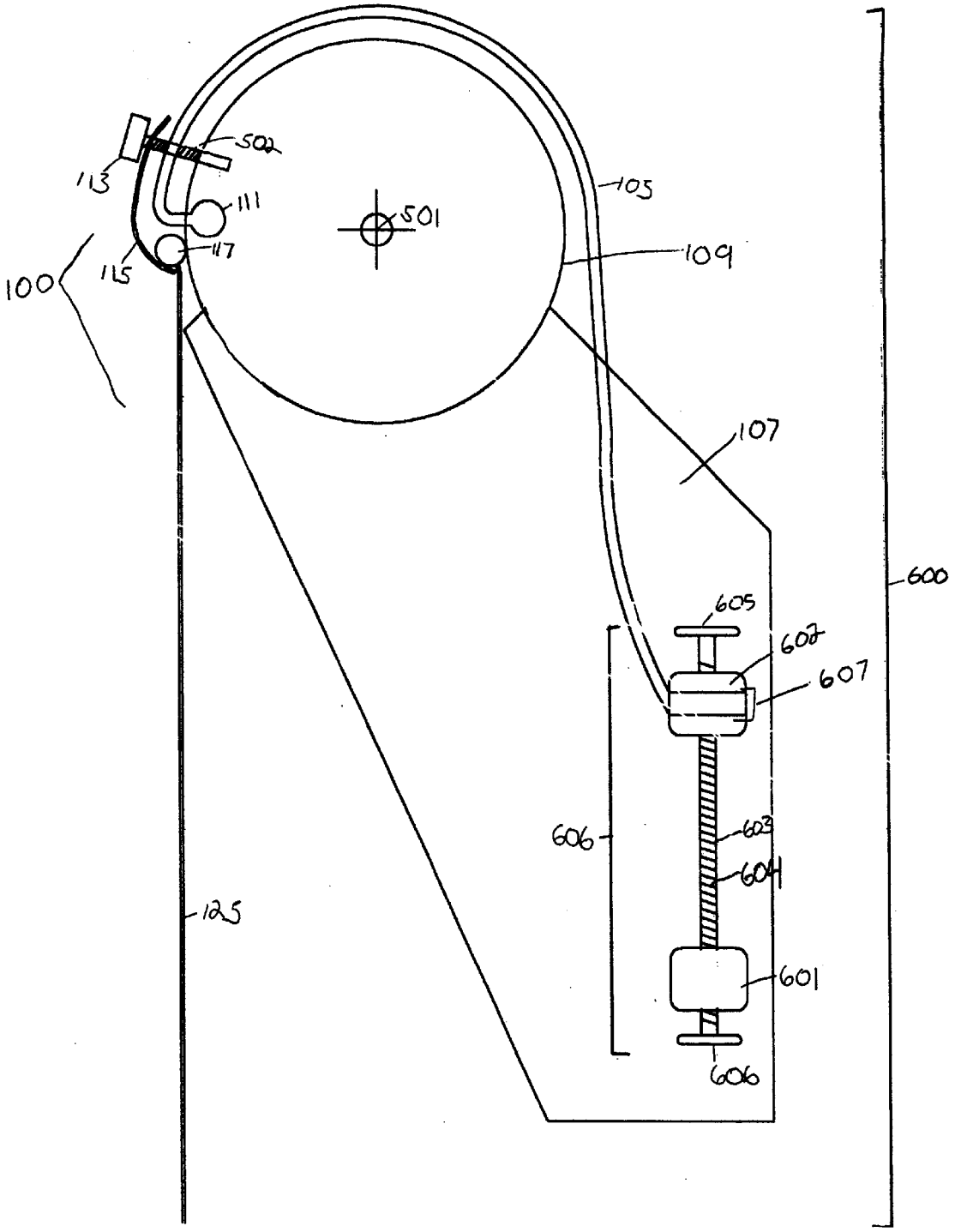
FIG. 6 is a detailed view of a second manner of banner assembly attachment/control means.

FIG. 6 depicts a second attachment means 600 in accordance with the present invention. Banner 100 is comprised of flexible region 125 and bar means 117. In the illustrated embodiment, mounting plate 107 structurally aligns the components of apparatus 600 and furthermore, is used for mounting the apparatus 600 to the surface the user wishes to display banner 100. Second attachment means 600, clamp 115 is used to keep bar means 117 locked in place. The locking of bar means 117 by clamp 115 is adjustable by screw 113 which is threaded 502 to mate with reel 109 Preferably, clamp 115 is adjusted by screw 113 such that bar means 117 may articulate by simply sliding into the plane of the figure. Screw 113 secures tension member 105 into rotatable reel 109. To prevent breakaway of the tension member 105, it is additionally fixed into rotatable reel 109 at point 111. Tension member 105 is then coupled to adjustment means 606. Adjustment means 606 comprise first block 602, second block 601 and threaded rod means 603. Threaded rod means 603 is affixed to backplate 107 by endplates 605 and 606. Endplates 605 and 606 should have sufficient height to allow rotation of first block 602 and second block 601. Second block 601 is adjustable along the length of rotationally constrained threaded rod means 603, and is used to set a maximum tension First block 602 has tension member 105 affixed thereto via tracks 607, thus allowing the rotation of first block 602 while maintaining attachment of tension member 105. By rotating first block 602, its threads mate with threads 604 of threaded rod means 603 and it translates downward, thus inducing a tensile stress in tension member 105. Second block 601 may be rotated, and thus translated along threaded rod means 603. Setting second block 601 to a position along threaded rod 603 sets a maximum tension by preventing translation of first block 602 beyond the position of second block 601. Furthermore, endplates 605 and 606 serve to set an absolute minimum and maximum tension, respectively. An access region could be provided to facilitate access to adjustment means 606. The tensile stress due to the downward translation of first block 602 effects rotation of rotatable reel 109 about center 501, which in turn induces a tensile stress in flexible region 125.

Figure 7:
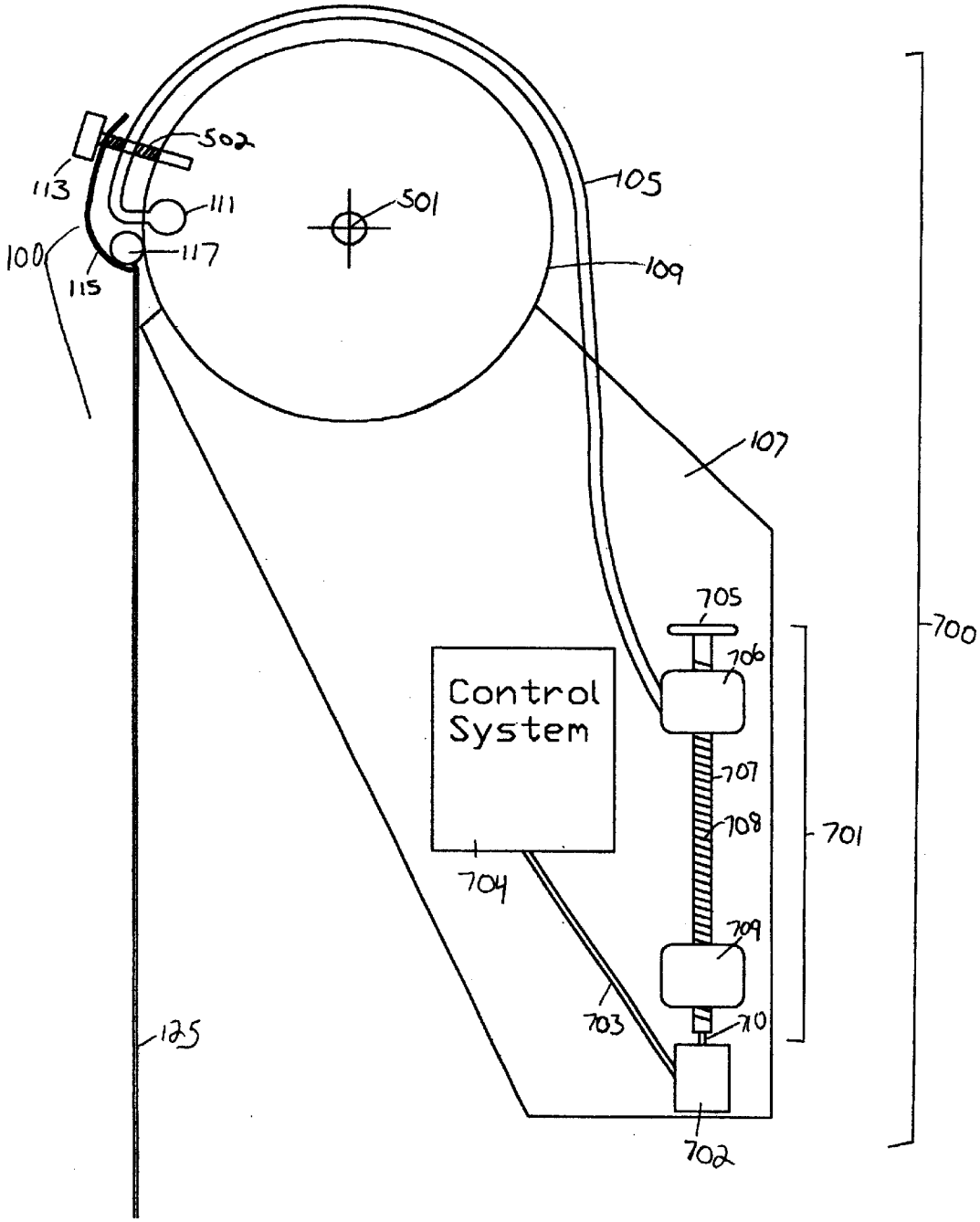
FIG. 7 is a detailed view of a third manner of assembly banner attachment/control means comprising automatic tensioning means.

FIG. 7 depicts a third attachment means 700 in accordance with the present invention Banner 100 is comprised of flexible region 125 and bar means 117 In the illustrated embodiment, mounting plate 107 structurally aligns the components of apparatus 700 and furthermore, is used for mounting the apparatus 700 to the surface the user wishes to display banner 100. Third attachment means 700, clamp 115 is used to keep bar means 117 locked in place. The locking of bar means 117 by clamp 115 is adjustable by screw 113 which is threaded 502 to mate with reel 109. Preferably, clamp 115 is adjusted by screw 113 such that bar means 117 may articulate by simply sliding into the plane of the figure. Screw 113 secures tension member 105 into rotatable reel 109. To prevent breakaway of the tension member 105, it is additionally fixed into rotatable reel 109 at point 111. Tension member 105 is then coupled to adjustment means 701. Adjustment means 701 comprise first block 706, second block 709 and threaded rod means 707. Second block 709 is positionally adjustable along the length of threaded rod means 707, and is used to set a maximum tension. Through rotation of threaded rod 707, first block 706, which has tension member 105 affixed thereto, translates downward, thus inducing a tensile stress in tension member 105. First block 706 has threads that mate with threads 708 of threaded rod means 707, and said first block 706 is constrained from rotating such that the rotation of threaded rod means 707 causes said downward translation. Second block 709, however, is not constrained from rotation Second block 709 has threads that mate with threads 708. Thus, the user may rotate second block 709 to any position along threaded rod 707, thereby setting a maximum tension. Threaded rod 707 is coupled, via axle 710, to motor 702. Motor 702 is connected to control system 704 via wire means 703. Control system 704 also contains either stored energy means to power motor 702, or may interface with any type external power source. A typical, though not exclusive, method of employing this apparatus is as follows. After setting an initial tension by manually rotating threaded rod means 707 and then setting a maximum tension with second block 709, the control system can be engaged. The control system 704 periodically sends power to motor 702, and by sensing the degree of rotation, the tension is adjusted. For example, if the control system pulses motor 702 and the tension is sufficient such that the motor has insufficient torque to rotate threaded rod means 707, power is immediately ceased. On the other hand, if motor 702 is pulsed and the control system senses that motor 702 is rotating, power is maintained until the motor has insufficient torque to continue rotating threaded rod means 707. The threads 708 of threaded rod means 707 may be varied to mate with the torque capabilities of the motor 702. The sensing can function, for example, by sensing the back EMF generated by motor 702 or its impedance, both of which vary when the motor is rotating or stalled. The myriad methods of motor monitoring known in the art are applicable to the present apparatus 700. An access region could be provided to facilitate access to adjustment means 701. Furthermore, it is contemplated that shield or casing he provided around control system 704, wire means 703 and motor means 702 to protect them from the environment and from human contact. The tensile stress caused by the rotation of threaded rod means 707 effects rotation of rotatable reel 109 about center 501, which in turn induces a tensile stress in flexible region 125.

Figure 8:
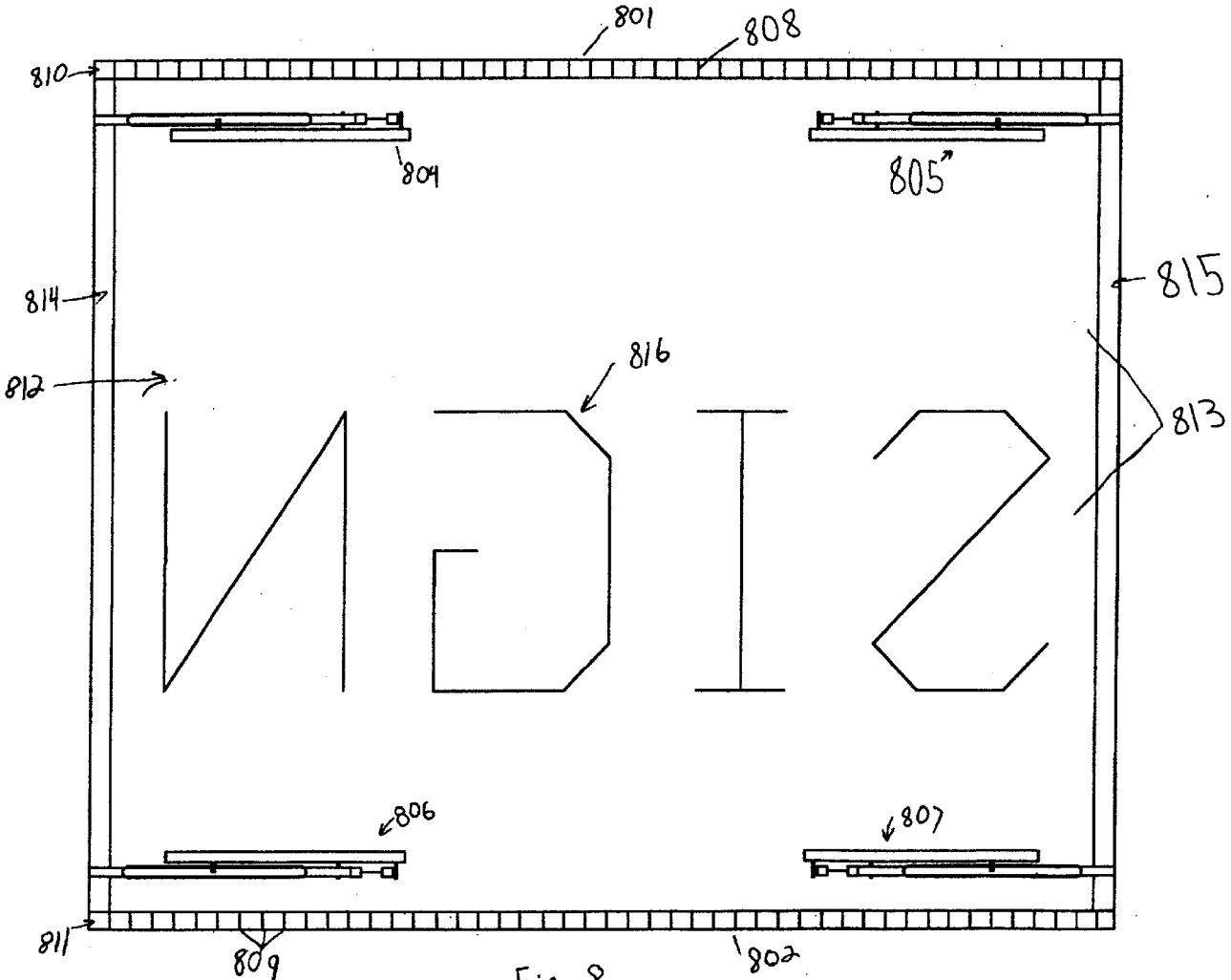
FIG. 8 is a rear view of an alternate embodiment of a banner support assembly in accordance with the present invention.

FIG. 8 depicts a rear view of an alternate embodiment of the present invention. Banner 813 is supported by a plurality of apparatus 804, 805, 806 and 807 that may be any of the variety thus far described as embodiments of the present invention For example, they may take the form of apparatus 101, 600 or 700 as described by FIG. 5, 6 or 7, respectively. Apparatus 804, 805, 806 and 807 are affixed to the surface that the user wishes to display banner 813. Banner 813 comprises bar means 814 and 815 that articulate with apparatus 804 and 806 and 805 and 807, respectively, as well as flexible region 812 with content 816. In addition to the tension mounting and adjustment means that have been heretofore described, a plurality of rods 810 and 811 are also employed. Banner 813 is outfitted with rings 808 and 809 that couple with said rods 810 and 811, respectfully. The arrangement is analogous to that of shower curtain rings articulated with a shower curtain rod. Rods 810 and 811 function to provide torsional stability for banner 813. Rods 810 and 811 also serve to enhance legibility of banner 813 by keeping edges 801 and 802, respectively, straight and properly aligned. Additionally, rods 810 and 811 increase resistance to high winds and also allow easier transport of a pre-tensioned banner.

Figure 9:
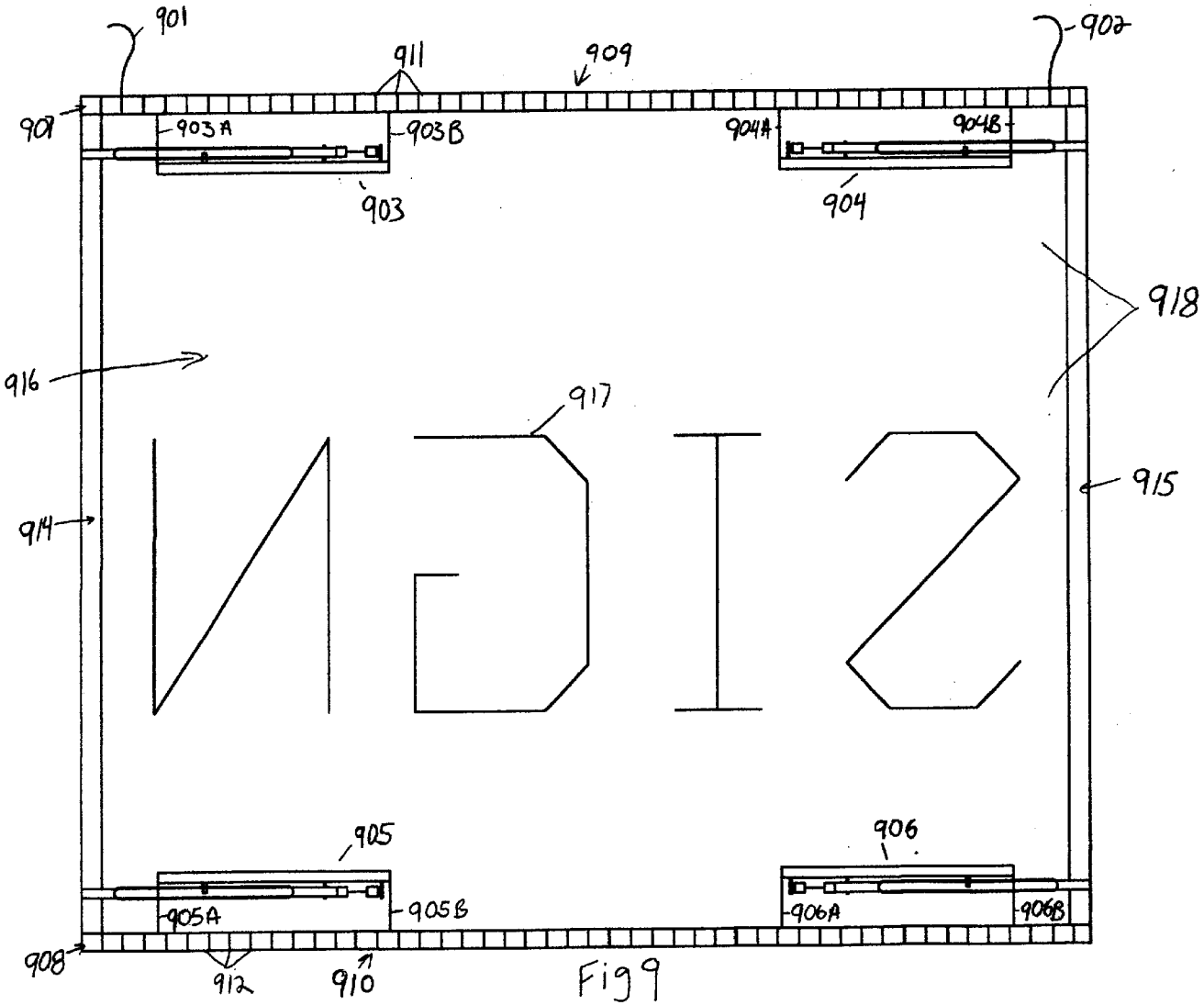
FIG. 9 is a rear view of an alternate embodiment of a banner support assembly using alternate mounting means in accordance with the present invention.

FIG. 9 depicts a rear view of an alternate embodiment of the present invention utilizing alternate attachment means 901 and 902. Banner 918 is supported by a plurality of apparatus 903, 904, 905 and 906 that may be any of the variety thus far described as embodiments of the present invention. For example, they may take the form of apparatus 101, 600 or 700 as described by FIG. 5, 6 or 7, respectively. Apparatus 903, 904, 905 and 906 are affixed to rods 907 and 908 by support members 903A, 903B, 904A, 904B, 905A, 905B, 906A and 906B. Rod 907 is then affixed to the surface that user wishes to display banner 918 by hooks 901 and 902. Banner 918 comprises bar means 914 and 915 that articulate with apparatus 903 and 905 and 904 and 906, respectively, as well as flexible region 916 with content 917. In addition to the tension mounting and adjustment means that have been heretofore described, a plurality of rods 907 and 908 are additionally employed. Banner 918 is outfitted with rings 911 and 912 that couple with said rods 907 and 908, respectfully. The arrangement is analogous to that of shower curtain rings articulated with a shower curtain rod. Rods 907 and 908 function to provide torsional stability for banner 918. Rods 907 and 908 also serve to enhance legibility of banner 918 by keeping edges 909 and 910, respectively, straight and properly aligned. Additionally, rods 907 and 908 increase resistance to high winds and also allow easy transport and mobility of a pre-tensioned banner.

While the present invention has been described with reference to preferred embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

What I claim is:

1. A banner support structure comprising:

a banner comprising a flexible region and a bar structure, said bar structure disposed at a plurality of edges of said banner; and a plurality of support structures, said support structures comprising a reel a tension member and an adjustment device, wherein said banner is coupled to said reel, said reel is coupled to said tension member, said tension member is coupled to said adjustment device and said bar structure is coupled to said reel with a clamp;

wherein said adjustment device when tightened, via coupling of said tension member, effects rotation of said reel in a fashion that induces a tensile stress in said banner.

2. A banner support structure according to claim 1, wherein said bar structure comprises at least one bar positioned at each horizontal edge.

3. A banner support structure according to claim 2, wherein said banner support structure utilizes two of said support structures at each horizontal edge.

4. A banner support structure according to claim 1, wherein said bar structure comprises at least one bar positioned at each vertical edge.

5. A banner support structure according to claim 4, wherein said banner support structure utilizes two of said support structures at each vertical edge.

6. A banner support structure according to claim 1 wherein said bar structure of said banner is cylindrical.

7. A banner support structure according to claim 1 wherein said flexible region of said banner contain advertising content.

8. A banner support structure according to claim 1 wherein said banner is rectangular.

9. A banner support structure according to claim 1 wherein said banner is square-shaped.

10. A banner support structure in accordance with claim 1 wherein said clamp adjustably couples said bar structure via a screw.

11. A banner support structure in accordance with claim 10 wherein said tension member is further coupled to said reel via said screw.

12. A banner support structure in accordance with claim 1 wherein said tension member is comprised of a stretchable material.

13. A banner support structure comprising:

a banner comprising a flexible region and a bar structure, said bar structure disposed at a plurality of edges of said banner; and a plurality of support structures, said support structures comprising a reel, a tension member and an adjustment device, wherein said banner is coupled to said reel, said reel is coupled to said tension member, and said tension member is coupled to said adjustment device; wherein said adjustment device when tightened, via coupling of said tension member, effects rotation of said reel in a fashion that induces a tensile stress in said banner, and further wherein said adjustment device comprises:

a threaded rod structure;

first block structure coupled to said tension member and further threaded upon said threaded rod structure, said first block structure is constrained from rotation; and second block structure threaded upon said threaded rod structure, wherein said second block structure is threaded upon said threaded rod structure prior to said first block structure;

wherein upon rotation of said threaded rod structure, said first block structure translate in a fashion to induce a tensile stress in said tension member, and further wherein the position of said second block structure sets a maximum tension by blocking further translation of said first block structure.

14. A banner support structure in accordance with claim 13, further comprising:

motor device coupled to said threaded rod structure via an axle; and control device, coupled to said motor device, to power and control said motor device;

wherein said motor device and control device function to maintain proper tension on said banner by periodically applying power to said motor device, and in cases of rotation, allowing said threaded rod structure to rotate until proper tension is detected, and in cases wherein said banner is already at proper tension, said motor device cannot rotate and said control device ceases power to said motor device.

15. A banner support structure according to claim 14 wherein a thread density of said threaded rod structure is varied to mate with the torque capabilities of said motor device.

16. A banner support structure comprising:

a banner comprising a flexible region and a bar structure, said bar structure disposed at a plurality of edges of said banner; and a plurality of support structures, said support structures comprising a reel a tension member and an adjustment device, wherein said banner is coupled to said reel, said reel is coupled to said tension member, and said tension member is coupled to said adjustment device; wherein said adjustment device when tightened, via coupling of said tension member, effects rotation of said reel in a fashion that induces a tensile stress in said banner, and further wherein said adjustment device comprises:

threaded rod structure, wherein said threaded rod structure is constrained from rotation;

first block structure coupled to said tension member and further threaded upon said threaded rod structure, wherein said tension member is coupled to said first block structure via a track that maintains secure coupling as said first block structure is rotated; and second block structure threaded upon said threaded rod structure, wherein said second block structure is threaded upon said threaded rod structure prior to said first block structure;

wherein upon rotation of said threaded rod structure, said first block structure translate in a fashion to induce a tensile stress in said tension member, and further wherein the position of said second block structure sets a maximum tension by blocking further translation of said first block structure.

* * * * *